US007931266B2

(12) United States Patent
Okamoto

(10) Patent No.: US 7,931,266 B2
(45) Date of Patent: Apr. 26, 2011

(54) SHEET FEEDING DEVICE AND IMAGE FORMING APPARATUS

(75) Inventor: Tsugio Okamoto, Gifu (JP)

(73) Assignee: Brother Kogyo Kabushiki Kaisha, Nagoya, Aichi (JP)

( * ) Notice: Subject to any disclaimer, the term of this patent is extended or adjusted under 35 U.S.C. 154(b) by 37 days.

(21) Appl. No.: 12/408,771

(22) Filed: Mar. 23, 2009

(65) Prior Publication Data

US 2009/0243190 A1 Oct. 1, 2009

(30) Foreign Application Priority Data

Mar. 28, 2008 (JP) ..... 2008-086916
Mar. 6, 2009 (JP) ..... 2009-053089

(51) Int. Cl.
*B65H 1/08* (2006.01)
*B65H 1/10* (2006.01)
*B65H 1/26* (2006.01)

(52) U.S. Cl. ..... 271/126; 271/148; 271/157; 271/160

(58) Field of Classification Search ..... 271/126, 271/127, 148, 157, 160
See application file for complete search history.

(56) References Cited

U.S. PATENT DOCUMENTS 5,931,455 A 8/1999 Okui et al.
6,364,309 B1 * 4/2002 Tomatsu ..... 271/160
7,618,037 B2 * 11/2009 Kang et al. ..... 271/157
7,669,846 B1 * 3/2010 Hoover et al. ..... 271/148
2006/0180987 A1 8/2006 Hattori

FOREIGN PATENT DOCUMENTS

| | | | |
|---|---|---|---|
| JP | 62-041748 U | | 3/1987 |
| JP | 03036124 A | * | 2/1991 |
| JP | 03-056326 A | | 3/1991 |
| JP | 04-235835 A | | 8/1992 |
| JP | 05-186062 | | 7/1993 |
| JP | 05-201557 | | 8/1993 |
| JP | 05-270667 | | 10/1993 |
| JP | 06-064769 A | | 3/1994 |
| JP | 09-272636 A | | 10/1997 |

(Continued)

OTHER PUBLICATIONS

JP Office Action dtd May 25, 2010, JP Appln. 2009-053089, English translation.

*Primary Examiner* — David H Bollinger
(74) *Attorney, Agent, or Firm* — Banner & Witcoff, Ltd.

(57) ABSTRACT

A sheet feeding device is provided. The sheet feeding device includes a sheet holder to hold a sheet in a position to be fed, a feed roller to pick up the sheet, a first lifter to move a closer portion of the sheet holder by one of a front end and a rear end thereof, a second lifter to move a further portion of the sheet holder by one of a front end and a rear end thereof, and a coordinating system to move the first lifter and the second lifter in cooperation with each other to move the overall sheet holder in a direction to be closer to the feed roller, wherein an amount of the sheet holder to be moved by the first lifter is greater according to a constant rate with respect to an amount of the sheet holder to be moved by the second lifter.

19 Claims, 9 Drawing Sheets

FOREIGN PATENT DOCUMENTS

| | | | |
|---|---|---|---|
| JP | 10-139178 | A | 5/1998 |
| JP | 10-203655 | | 8/1998 |
| JP | 11-011690 | A | 1/1999 |
| JP | 11-049381 | A | 2/1999 |
| JP | 11-189343 | | 7/1999 |
| JP | 2000-025964 | | 1/2000 |
| JP | 2000-038226 | | 2/2000 |
| JP | 2000-143004 | A | 5/2000 |
| JP | 2001-199562 | | 7/2001 |
| JP | 2001-287838 | A | 10/2001 |
| JP | 2002-080128 | | 3/2002 |
| JP | 2002-087622 | | 3/2002 |
| JP | 2002-274663 | | 9/2002 |
| JP | 2006-096479 | A | 4/2006 |

* cited by examiner

SHEET FEEDING DEVICE AND IMAGE FORMING APPARATUS

CROSS REFERENCE TO RELATED APPLICATION

This application claims priority from Japanese Patent Applications Nos. 2008-086916 filed on Mar. 28, 2008, and 2009-053089 filed on Mar. 6, 2009, the entire subject matters of which are incorporated herein by reference.

BACKGROUND

1. Technical Field

An aspect of the present invention relates to a sheet feeding device having a shifting unit to move a holder plate, holding a stack of sheets, toward a sheet feeding roller and an image forming apparatus having the sheet feeding device.

2. Related Art

Conventionally, an image forming apparatus having a detachable sheet cassette, in which a stack of recording sheets are contained, in a bottom portion thereof has been known. The stack of recording sheets are held on a swingable holder plate, which is installed on a bottom of the sheet cassette, so that the recording sheets can be picked up by a feed roller and fed in a sheet feeding path to a printing unit. The picked-up recording sheets are separated in between a separator roller and a separator pad so that solely a topmost sheet can be fed in the sheet feeding path at a time. Such a sheet feeding device is disclosed in, for example, Japanese Patent Provisional Publication No. 2006-96479.

According to the disclosure, the holder plate is provided in the sheet cassette with a side further from the feed roller being rotatably attached to a bottom of the sheet cassette so that a side of the holder plate nearer to the feed roller can be shifted. Thus, the sheet stack is maintained in an uplifted position in the sheet cassette and a topmost sheet in the sheet stack reaches the feed roller to be fed even when a level of the sheet stack in the sheet cassette is low.

However, when the holder plate is pivoted about the further side and the nearer side is uplifted, an angle of the topmost sheet with respect to the feed roller varies from moderate to acute as the level of the sheet stack becomes lower. In this regard, because the angle of the topmost sheet with respect to the feed roller is not constant, the sheets may not always be fed in the sheet feeding path properly. Namely, when a plane including the topmost sheet is not substantially inclined with respect to the feed roller, the recording sheet fed by the feed roller may reach solely to the separator pad but not reach in between the separator roller and the separator pad (see FIG. 10A). Thus, idle feeding, in which the sheet is not forwarded further, may occur. Meanwhile, when a plane including the topmost sheet is inclined at an excessively acute angle, the recording sheet may be nipped with the separator roller and an upper portion of the separator pad (see FIG. 10B). In this event, double-feeding, in which two or more sheets picked up at one time are forwarded further, may occur.

In order to prevent the angle variation, a structure to uplift the holder plate with a topmost plane of the sheet stack being maintained to be parallel with the bottom of the cassette has been suggested in, for example, Japanese Patent Provisional Publication No. 2002-87622. According to the configuration, when the picked-up sheet is fed in the sheet feeding path to a printing unit, which is arranged in an upper portion of the image forming apparatus above the cassette, the sheet is turned acutely along the sheet feeding path curved at nearly 180 degrees, and therefore, a size of the entire image forming apparatus tends to be larger. In order to maintain the apparatus downsized, it is more advantageous that the holder plate is inclined even at a small angle to maintain the side of the holder plate nearer to the feed roller higher. Meanwhile, a structure to maintain the holder plate with the sides both nearer to and further from the feed roller inclined and uplift simultaneously is suggested in, for example, Japanese Patent Provisional Publication No. H10-203655. According to the disclosure, the further side of the holder plate is guided along guide grooves, which are formed in the cassette and angled toward the feed roller, to follow the nearer side of the holder plate being uplifted.

SUMMARY

According to the latter publication, however, the guide grooves are provided to guide the further side of the holder plate along with the nearer side which is uplifted along linear rack gears. In this regard, inclination of the guide grooves to guide the further side is less acute than inclination of the rack gears. Therefore, an angle of the topmost sheet in the sheet stack arranged on the holder plate with respect to the feed roller is not specifically adjustable. Thus, irregular feeding of the sheets (i.e., idle feeding and double-feeding) is still anticipated to occur.

In view of the above drawbacks, the present invention is advantageous in that a sheet feeding device with a holder plate, of which inclination with respect to the feed roller can be controlled, and an image forming apparatus with the sheet feeding device are provided.

According to an aspect of the present invention, a sheet feeding device to feed a sheet in a sheet stack into a sheet feeding path along a sheet feeding direction is provided. The sheet feeding device includes a sheet holder to hold the sheet in a position to be fed, a feed roller to be rotated to pick up the sheet from the sheet stack and arranged in a position, in which the sheet becomes in contact with the feed roller, a first lifter, having a front end and a rear end, to move a closer portion of the sheet holder, being closer to the feed roller, by one of the front end and the rear end, a second lifter, having a front end and a rear end, to move a further portion of the sheet holder, being further from the feed roller, by one of the front end and the rear end, and a coordinating system to move the first lifter and the second lifter in cooperation with each other to move the overall sheet holder in a direction to be closer to the feed roller. An amount of the sheet holder to be moved by the first lifter is greater according to a constant rate with respect to an amount of the sheet holder to be moved by the second lifter.

According to the above configuration, angle variation of a topmost recording sheet in the sheet stack held by the sheet holder with respect to a separator can be restrained so that irregular feeding of the sheets can be avoided from occurring regardless of an amount of remaining sheets in the sheet stack.

According to another aspect of the present invention, an image forming apparatus is provided. The image forming apparatus includes a sheet feeding device to feed a sheet in a sheet stack along a sheet feeding direction, an image forming unit, arranged on a portion substantially above the sheet feeding device, to form the image on the sheet being fed by the sheet feeding device, and a sheet feeding path to guide the sheet being fed by the sheet feeding device upwardly to the image forming unit. The sheet feeding device includes a sheet holder to hold the sheet in a position to be fed, a feed roller to be rotated to pick up the sheet from the sheet stack and arranged in a position, in which the sheet becomes in contact with the feed roller, a separator arranged in a downstream side of the sheet feeding path with respect to the feed roller to separate the sheet from a succeeding sheet in the sheet stack, a first lifter, having a front end and a rear end, to move a closer portion of the sheet holder, being closer to the feed roller, by one of the front end and the rear end, a second lifter, having a front end and a rear end, to move a further portion of the sheet holder, being further from the feed roller, by one of the front end and the rear end, and a coordinating system to move the first lifter and the second lifter in cooperation with each other to move the overall sheet holder in a direction to be closer to the feed roller. An amount of the sheet holder to be moved by the first lifter is greater according to a constant rate with respect to an amount of the sheet holder to be moved by the second lifter.

According to the above configuration, the topmost sheet can be inclined toward the feed roller along the sheet holder so that the sheet feeding path can be formed to have smaller curvature to guide the sheet to the image forming unit. Therefore, the entire image forming apparatus can be downsized.

BRIEF DESCRIPTION OF THE ACCOMPANYING DRAWINGS

DETAILED DESCRIPTION

Figure 1:
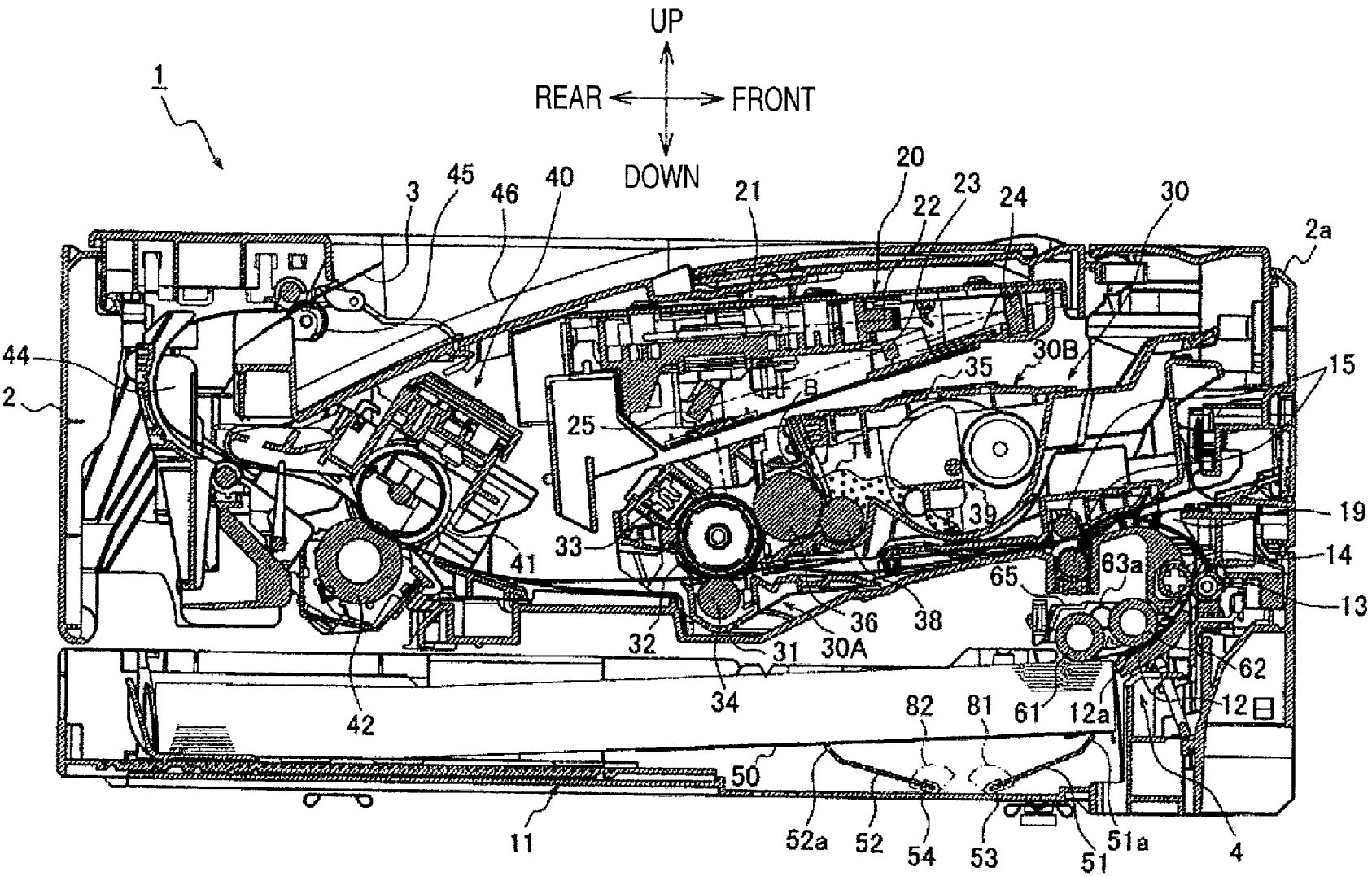
FIG. 1 is a cross-sectional side view of a laser printer according to a first embodiment of the present invention.

Hereinafter, embodiments according to aspects of the present invention will be described with reference to the accompanying drawings. FIG. 1 is a cross-sectional side view of a laser printer 1 according to a first embodiment of the present invention. In FIG. 1, a right-hand side is referred to as front of the laser printer 1, and a left-hand side is referred to as rear of the laser printer 1. Further, a near side and a far side are respectively referred to as left and right of the laser printer 1.

Overall configuration of the laser printer 1 according to the first embodiment will be described. The laser printer 1 includes a feeder device 4 to feed a recording sheet 3, an image forming unit 5 to form an image on the recording sheet 3, and a casing 2 in which the feeder device 4, the image forming unit 5, and other components are stored. The image forming unit 5 is arranged substantially above the feeder device 4. On a front side of the casing 2, an openable/closable front cover 2*a* is provided. The front cover 2*a* covers an opening in which a process cartridge 30 is removably set. Configuration of the process cartridge 30 will be described later in detail.

The feeder device 4 includes a sheet cassette 11, a holder plate 50, a first lifter plate 51, and a second lifter plate 52. The sheet cassette 11 is a cassette to be removably attached to a bottom portion of the casing 2, and a stack of recording sheets 3 is placed therein. The holder plate 50 is provided to hold the recording sheets 3 in a position to be fed in the sheet cassette 11 and is pivotable about a rear end thereof so that a front end thereof is uplifted and lowered according to the pivoting motions.

The feeder device 4 further includes a feed roller 61, which is provided above the front end of the sheet feed tray 11, and a separator roller 62 in a position nearer to the front with respect to the feed roller 61. The feed roller 61 is in a position to be in contact with a topmost recording sheet 3 in the uplifted sheet stack in the sheet cassette 11. The separator roller 62 is arranged to mutually abut a separator pad 12*a*, which is a piece made of a material with resiliency. The separator pad 12*a* is provided with expanding force by a spring (not shown) and presses the recording sheet 3 being carried by the separator roller 62 on a surface opposite from a surface being in contact with an outer peripheral surface of the separator roller 62. It is to be noted that the separator pad 12*a* may be replaced with a roller with resiliency to mutually abut the separator roller 62 and rotate in the opposite direction from the separator roller 62. Alternatively, the recording sheets 3 may be separated solely by the separator pad 12*a*.

Thus, the recording sheet 3 picked up by the feed roller 61 is nipped between the separator roller 62 and the separator pad 12*a* to be separated by friction occurring therebetween from a successive recording sheet which may otherwise be carried along with the recording sheet 3. The sheet stack is placed on the sheet holder 50 with the topmost recording sheet 3 being in contact with the feed roller at the front end thereof, and the topmost recording sheet 3 is inclined to have the front end thereof closer to the feed roller 61 to be higher than the rear end being further from the feed roller 61. The separator roller 62 is arranged to have a lower portion of the outer peripheral surface thereof to be an extension of the inclination of the topmost recording sheet 3. The separator pad 12*a* is supported by a guide piece 12. A top surface of the separator pad 12*a* is included in the sheet feeding path 19 and inclined upwardly toward a downstream side of the sheet feeding path 19. The sheet feeding path 19 further includes a dust remover roller 13 and a paired roller 14 thereof, a pair of register rollers 15, and a guide wall (not shown) to guide the recording sheet 3. The recording sheet 3 is thus forwarded to the image forming unit 5.

The image forming unit 5 provided approximately above the feeder device 4 in the casing 2 includes a scanner unit 20, a process cartridge 30, and a fixing unit 40 and forms an image on a surface of the recording sheet 3.

The scanner unit 20 includes a laser emitter (not shown), a rotatable polygon mirror 21, lenses 22 and 23, and reflecting mirrors 24, 25. Laser beam emitted from the laser emitter according to predetermined image data is reflected by or transmitted through the polygon mirror 21, the lens 22, the reflecting mirror 24, the lens 23, and the reflecting mirror 25 as shown in a dotted chain line in FIG. 1. The transmitted laser beam is thus irradiated to scan a surface of a photosensitive drum 23 in the process unit at a high speed.

The process cartridge 30, which can be detached from the casing 2, is disposed approximately below the scanner unit 20 and includes a drum cartridge 30A, which holds a photosensitive drum 32 therein, and a developer cartridge 30B, which is removably attached to the photosensitive drum cartridge 30A and contains a developer agent (e.g., toner) T therein.

The drum cartridge 30A is provided with a case 31, in which the photosensitive drum 32, a scorotoron charger 33, and a transfer roller 34 are housed. The developer cartridge 30B is provided with a developer case 35, in which the developer agent is contained, a developing roller 36, a supplier roller 38, and an agitator 39.

The developer agent T in the developer case 35 is agitated by the agitator 39 and supplied to the developing roller 36 as the supplier roller 38 rotates. Between the supplier roller 38 and the developing roller 36, the developer agent T being transferred is frictionally charged positively and carried according to rotation of the developing roller to a portion between a developer thickness adjusting blade B and the developing roller 36 in which the developer agent is further and substantially charged. Thus, the developer agent is evenly applied over the surface of the developing roller 36 to form a thin layer.

The photosensitive drum 32 is provided to be rotatable and arranged in parallel with and to be in contact with the developing roller 36. The photosensitive drum 32 includes a drum body (not shown), which is grounded, and a positively chargeable photosensitive layer (not shown) to cover the drum body.

The scorotoron charger 33 is arranged approximately above the photosensitive drum 32 in a position to be substantially apart from the photosensitive drum 32. The scorotoron charger 33 is a corona charger which electrically discharges through electrically charging wires (not shown). The surface of the photosensitive drum 32 is uniformly charged with positive polarity to a predetermined level by the scorotoron charger 33.

The transfer roller 34 is arranged below the photosensitive drum 32 to be in parallel with the rotation axis of the photoconductive drum 32 and is supported by the drum case 31 rotatably. The transfer roller 34 includes a rotation shaft (not shown) made of a metal and a roller layer (not shown) made of conductive rubber to cover the rotation shaft. On the surface of the transfer roller 34, a predetermined level of transfer bias of a reverse polarity to the photosensitive drum 32 is applied so that the image developed on the surface of the photosensitive drum 32 is transferred to the surface of the recording sheet 3 to form the normal image when the recording sheet 3 is carried in between the photosensitive drum 32 and the transfer roller 34.

The surface of the photosensitive drum 32 is exposed to laser beam that scans the surface of the photosensitive drum 32 in parallel with the rotation axis according to image data, and a latent image is formed on the surface of the photosensitive drum 32, as regions where the latent image is formed gains a lower potential due to an effect of the laser beam. As the photoconductive drum 32 with the latent image on the surface thereof is rotated, the developer agent positively charged on the surface of the developing roller 34 is transferred and adhered to the lower-potential region, which corresponds to the latent image on the surface of the photosensitive drum 32. Thus, the latent image is developed to be a reverse image.

The fixing unit 40 is disposed on a downstream side of the sheet feeding path 19 with respect to the process cartridge 30. The fixing unit 40 includes a heat roller 41 with a heat source (not shown) and a pressure roller 42, which is pressed to be in contact with the heat roller 41. The toner image transferred onto the recording sheet 3 in the process cartridge 30 is thermally fixed thereto when the recording sheet 3 is fed between the heat roller 41 and the pressure roller 42. The recording sheet 3 fed along a discharging path 44 is passed to a pair of discharge rollers 45 to be discharged out of the laser printer 1. The discharged recording sheet 3 is received by a discharge tray 46.

Next, configuration of the feeder device 4 will be described in detail. The feed roller 61 and the separator roller 62 are respectively provided with a feed roller gear (not shown) and a separator roller gear (not shown), which are respectively rotatable integrally with the feed roller 61 and the separator roller 62. The feed roller gear and the separator roller gear are engaged via an idle gear 63*a* and rotate substantially synchronously in a same direction.

The feed roller 61, the feed roller gear, the separator roller 62, the separator roller gear, and the idle gear 63*a* are rotatably supported by a roller gear holder 65. The roller gear holder 65 are fixed to a frame (not shown), which is fixed to a predetermined position in the casing 2 to be in a fixed position with respect to the dust remover roller 13.

Figure 2A:
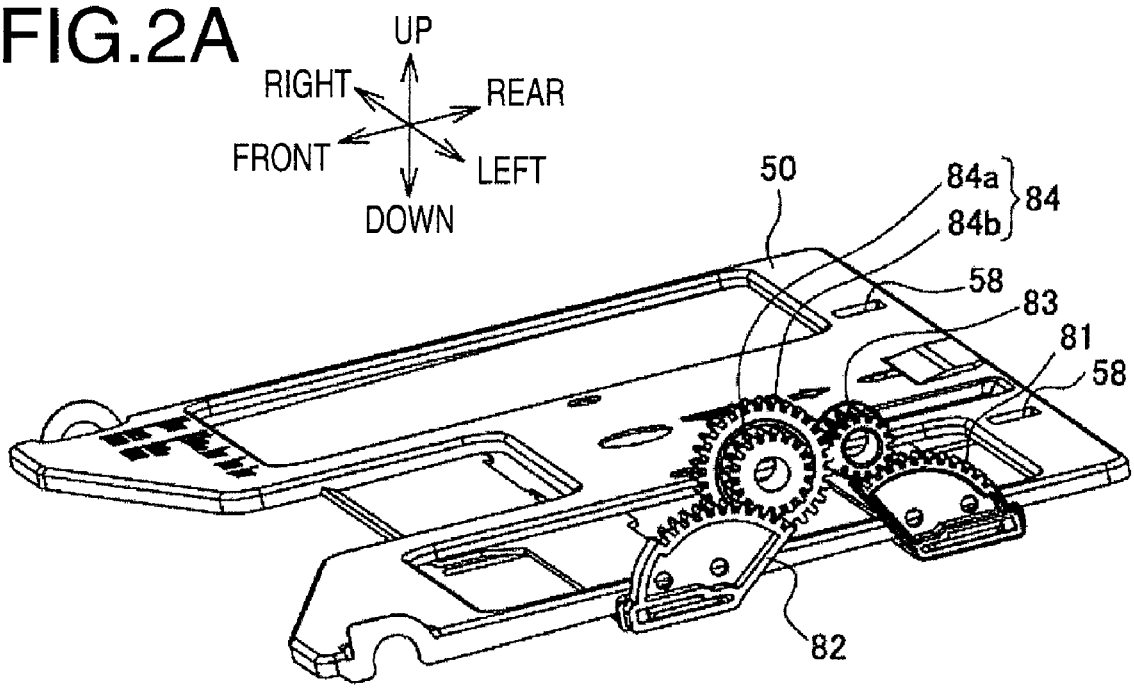
FIGS. 2A and 2B are a perspective view and a side view of a holder plate in a lower position with a coordinating system according to the first embodiment of the present invention.
Figure 2B:
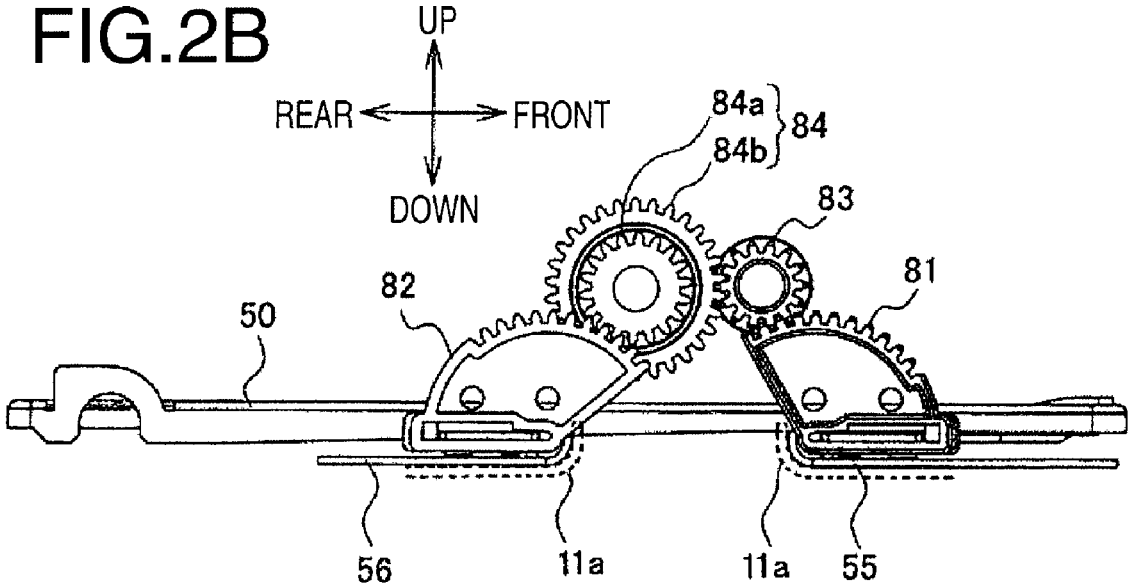
Figure 3:
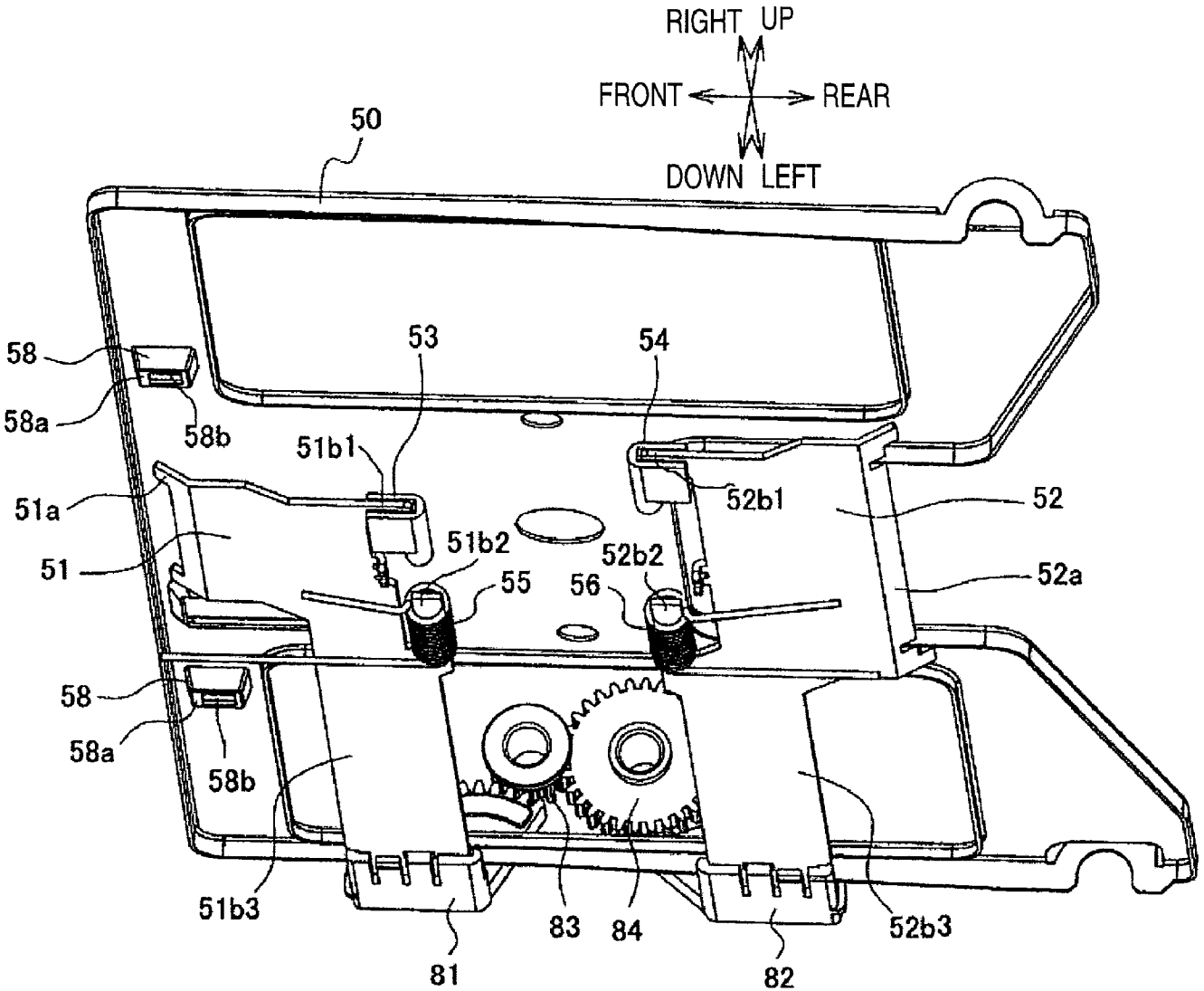
FIG. 3 is a perspective view of the lower surface of the holder plate in the lower position with the coordinating system according to the first embodiment of the present invention.
Figure 4A:
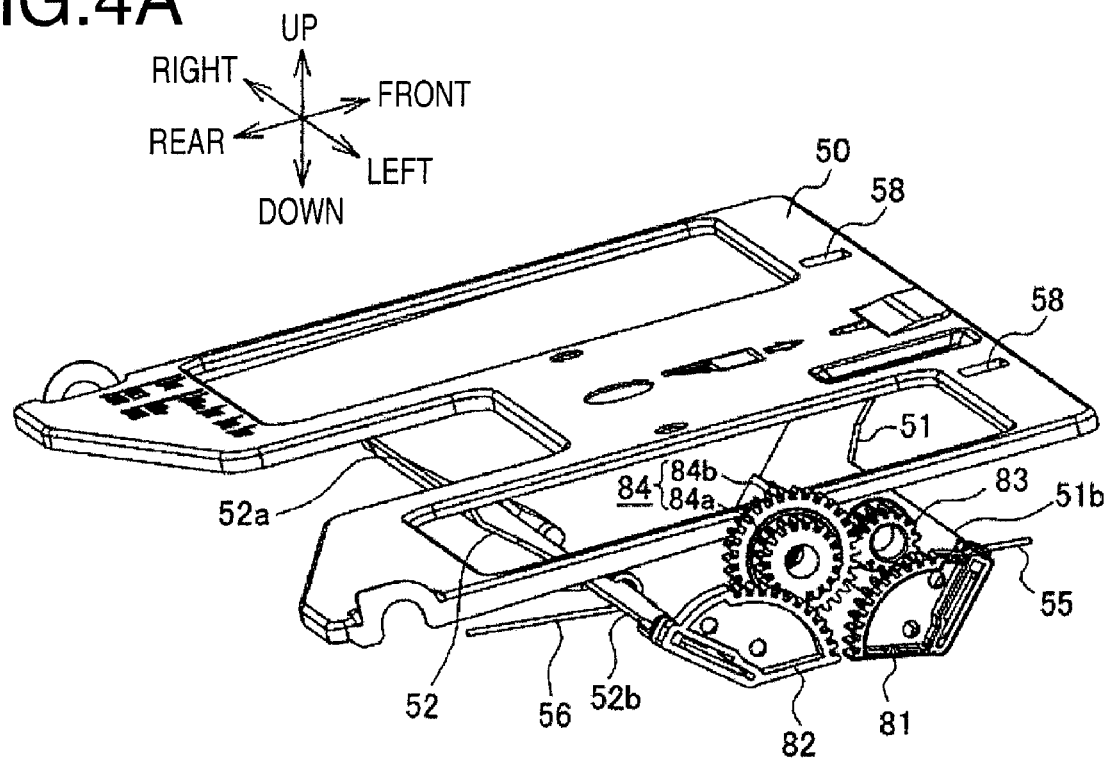
FIGS. 4A and 4B are perspective view and a side view of the holder plate in an uplifted position with the coordinating system according to the first embodiment of the present invention.
Figure 4B:
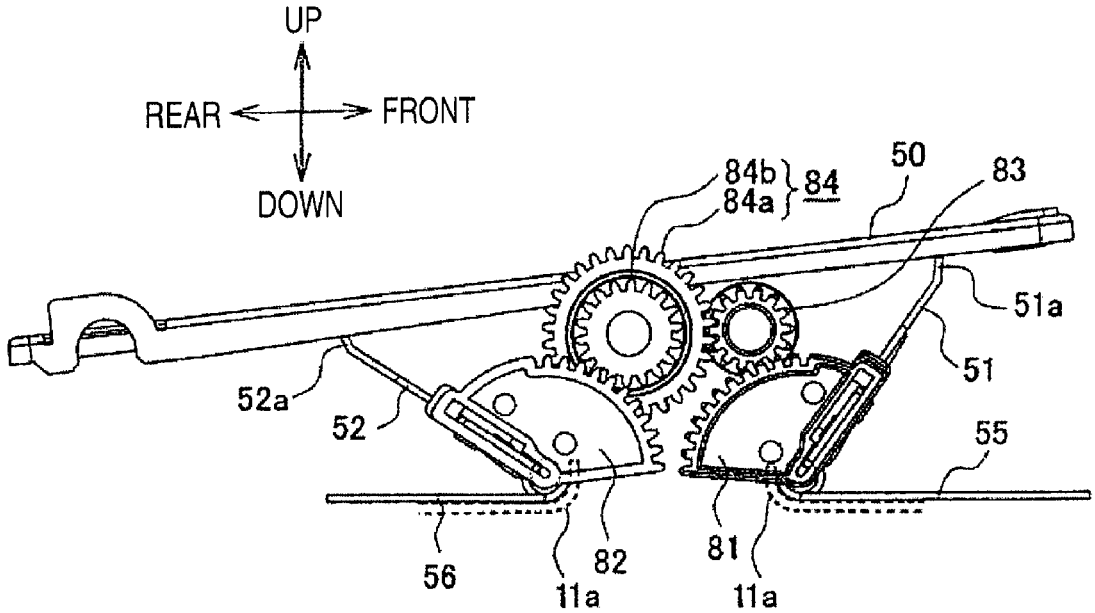
Figure 5:
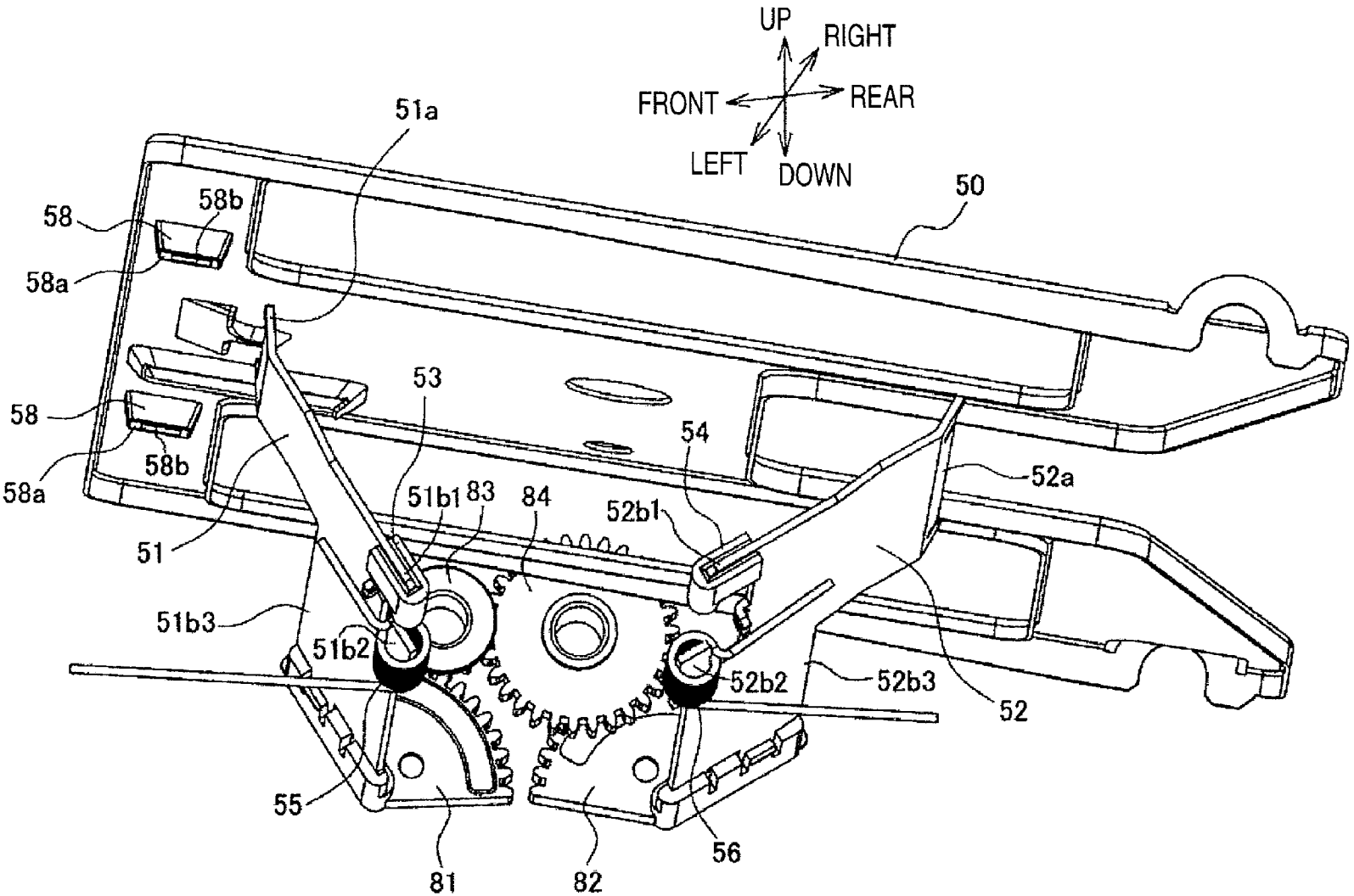
FIG. 5 is a perspective view of the lower surface of the holder plate in the uplifted position with the coordinating system according to the first embodiment of the present invention.

Next, a mechanism to uplift the holder plate 50 by the first lifter plate 51 and the second lifter plate 52 will be described. FIG. 2A is a perspective view of a top surface of the holder plate 50 in a lower position according to the first embodiment of the present invention. FIG. 2B is a side view of the holder plate 50 in the lower position according to the first embodiment of the present invention. FIG. 3 is a perspective view of a lower surface of the holder plate 50 in the lower position according to the first embodiment of the present invention. FIG. 4A is a perspective view of the top surface of the holder plate 50 in an uplifted position according to the first embodiment of the present invention. FIG. 2B is a side view of the holder plate 50 in the uplifted position according to the first embodiment of the present invention. FIG. 5 is a perspective view of the lower surface of the holder plate 50 in the uplifted position according to the first embodiment of the present invention.

The first lifter plate 51 and the second lifter plate 52 are provided below the holder plate 50 to uplift the holder plate 50. Each of the first and the second lifter plates 51, 52 is formed to have a width which extends perpendicularly to the sheet feeding direction and in parallel with a width of the recording sheet 3. The first and the second lifter plates 51, 52 are arranged in line in parallel with the sheet feeding direction with sides close to each other (i.e., a rear end of the first lifter plate 51 and a front end of the second lifter plate 52) pivotally attached to the bottom of the sheet cassette 11 and substantially spaced from each other. The first lifter plate 51 is arranged to have a front end 51*a* thereof to be in contact with a lower surface of the holder plate 50, and the second lifter plate 52 is arranged to have a rear end 52*a* to be in contact with the lower surface of the holder plate 50.

The side of the first lifter plate closer to the second lifter plate 52 (i.e., the rear end of the first lifter plate 51) includes a supportive portion 51*b*1 and a protruding portion 51*b*2. The supportive portion 51*b*1 is formed on one side of the rear end of the first lifter plate 51 and covered with a supporting piece 53, which is made of resin and has a cross-sectional shape of U. The protruding portion 51*b*2 is formed to confront the supportive portion 51*b*1 and to protrude in a direction parallel with the width of the first lifter plate 51. Similarly, the side of the second lifter plate closer to the first lifter plate 51 (i.e., the front end of the second lifter plate 52) includes a supportive portion 52*b*1 and a protruding portion 52*b*2. The supportive portion 52*b*1 is formed on one side of the front end of the second lifter plate 51 and covered with a supporting piece 54, which is made of resin and has a cross-sectional shape of U. The protruding portion 52*b*2 is formed to confront the supportive portion 52*b*1 and to protrude in a direction parallel with the width of the second lifter plate 52. The protruding portions 51*b*2, 52*b*2 are respectively provided with torsion coil sprints 55, 56, which are wound around peripheries of the protruding portions 51*b*2, 52*b*2.

At least one of the supporting piece 53 and an outer periphery of the torsion coil spring 55 of the first lifter plate 51 is pressed to fit to and supported by a curve of an upright portion 11*a*, which is formed on the bottom surface of the sheet cassette 11. Similarly, at least one of the supporting piece 54 and an outer periphery of the torsion coil spring 56 of the second lifter plate 52 is pressed to fit to and supported by a curve of an upright portion 11*a*. Thus, the first and the second lifter plates 51, 52 are supported on the bottom of the sheet cassette 11 to pivot about the ends which are closer to each other.

The first lifter plate 51 is arranged underneath the holder plate 50 to have the front end 51*a* thereof to be in contact with the lower surface of the holder plate 50, and the holder plate 50 is uplifted and moved by the first lifter plate 51 at a portion which is closer to the front than a gravity center thereof. The second lifter plate 52 is arranged to have the rear end 52*a* thereof to be in contact with the lower surface of the holder plate 50, and the holder plate 50 is moved and uplifted by the second lifter plate 52 at a portion which is closer to the rear than a gravity center thereof. Thus, the holder plate 50 is held by the first and the second lifter plates 51, 52 at portions, which are in line in parallel with the sheet feeding direction to have the gravity center of the holder plate 50 therebetween. As the first lifter plate 51 and the second lifter plate 52 are pivoted about the rear end of the first lifter plate 51 and the front end of the second lifter plate 52 respectively, the front end 51*a* of the first lifter plate 51 and the rear end 52*a* of the second lifter plate 52 are upraised, and accordingly, the holder plate 50 is overall lifted upward in a direction to be closer to the feed roller 61.

As shown in FIGS. 3 and 5, the front end 51*a* of the first lifter plate 51 is angled toward the holder plate 50 and in contact with the lower surface of the holder plate 50. Meanwhile, the rear end 52*a* of the second lifter plate 52 is angled toward the holder plate 50 and in contact with the lower surface of the holder plate 50. It is to be noted that the first lifter plate 51 with the angled front end 51*a* and the second lifter plate 52 with the angled rear end 52*a* can be suitably situated underneath the holder plate 50 when the first lifter plate 51 and the second lifter plate 52 are in positions to be in parallel with the holder plate 50 (see FIG. 3). Each of the front end 51*a* and the rear end 52*a* is formed to have extended portions at least at both sides of the front end 51*a* and the rear end 52*a* respectively. Thus, the holder plate 50 is held at least by the two extended portions of the first lifter plate 51 and the two extended portions of the second lifter plate 52.

Thus, the holder plate 50 is moved in up-and-down direction by the first and the second lifter plates 51, 52 and movements toward the front, the rear, the left, and the right are restricted by the side walls of the sheet cassette 11. The torsion coil springs 55, 56 are respectively in contact with the first lifter plate 51 and the second lifter plate 52 at one end and with the bottom surface of the sheet cassette 1 at the other end. With expanding effects of the resilient torsion coil springs 55, 56, the first lifter plate 51 and the second lifter plate 52 are upraised, and the holder plate 50 is overall lifted upward in a direction to be closer to the feed roller 61.

The first lifter plate 51 and the second lifter plate 52 are pivoted in cooperation with each other by a coordinating system 90, which will be described hereinbelow. The first lifter plate 51 and the second lifter plate 52 are formed to have arm portions 51*b*, 52*b* respectively, which are elongated leftward to extend beyond the left end of the holder plate 50. Further, the arm portions 51*b*, 52*b* are respectively provided with a first sector-formed gear 81 and a second sector-formed gear 82, which are orthogonally coupled to widthwise edges of the arm portions 51*b*, 52*b* and in positions to be outside of widthwise edges of the holder plate 50. As shown in FIGS. 2A, 2B and 4A, 4B, the first gear 81 coupled to the first lifter plate 51 is engaged with an idle gear 83, which is engaged with a reduction gear 84. The reduction gear 84 includes a larger diameter portion 84*b* and a smaller diameter portion 84*a*, and the larger diameter portion 84*b* is engaged with the idle gear 83 whilst the smaller diameter portion 84*a* is engaged with the second gear 82. The idle gear 83 and the reduction gear 84 are, although not specifically shown, rotatably supported by a side wall of the sheet cassette 11. Therefore, an amount of the first lifter plate 51 to be upraised (pivoted) is greater than an amount of the second lifter plate 52 to be upraised (pivoted) according to a gear ratio of the first gear 81 and the second gear 82 through the idle gear 83 and the reduction gear 84. In other words, the first lifter plate 51 is upraised in a constant speed rate which is higher with respect to a speed of the second lifter plate 52 to be upraised.

When the holder plate 50 is at a lowest position in the sheet cassette 11, as shown in FIGS. 2A and 2B, the holder plate 50, the first lifter plate 51, and the second lifter plate 52 are oriented to be substantially parallel with the bottom surface of the sheet cassette 11. It is preferable that the holder plate 50 and the first and the second lifter plates 51, 52 are set in the lowest positions in the sheet cassette 11 when the sheet cassette 11 is removed from and installed in the laser printer 1. When the holder plate 50 is in the lowest position and the sheet cassette 11 is fully loaded with the recording sheets 3, the topmost recording sheet 3 is in a position lower than and apart from the outer periphery of the feed roller 61.

When the first lifter plate 51 and the second lifter plate 52 are pivoted by the expanding force of the torsion coil springs 55, 56 respectively, the holder plate 50 is uplifted at the portions being in contact with the arm portions 51*b*, 52*b*, i.e., at the portion closer to the front than the gravity center and at the portion closer to the rear than the gravity center. However, the front end (i.e., the side closer to the feed roller 61) of the holder plate 50 is uplifted in a faster speed to be higher than the rear end (see FIGS. 4A and 4B). The ascending motion of the holder plate 50 stops when the topmost sheet 3 in the sheet stack placed on the holder plate 50 reaches the feed roller 61.

Figure 6:
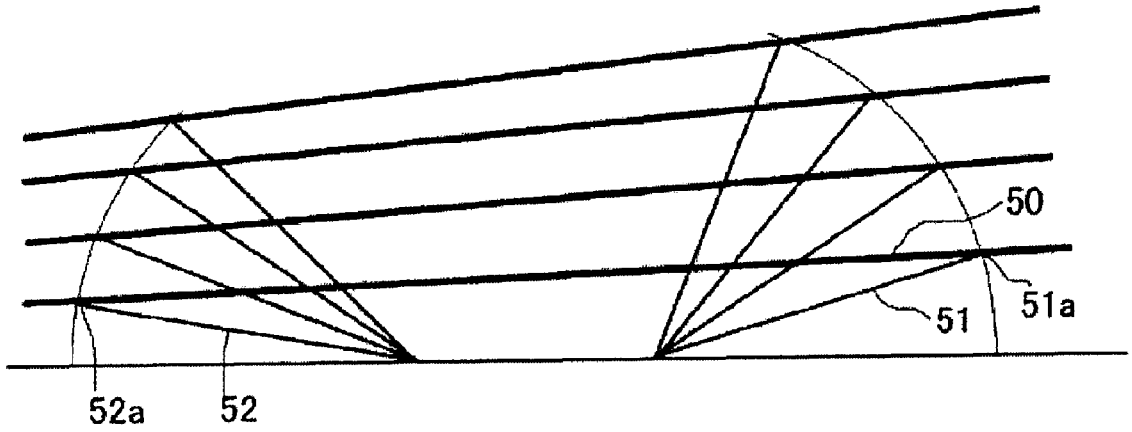
FIG. 6 is an illustrative side view of the holder plate being uplifted according to the first embodiment of the present invention.

FIG. 6 is an illustrative side view of the holder plate 50 being uplifted during decrease of the recording sheets in the sheet stack according to the first embodiment of the present invention. When the first lifter plate 51 is upraised to be higher than the second lifter plate 52 according to a speed rate in the constant ratio with respect to a speed rate of the second lifter plate 52 to be upraised. Thus, the holder plate 50 is inclined to have the front end being higher than the rear end. However, angle variation of the holder plate 50 to be inclined is not as great as angle variations of the first and the second lifter plates 51, 52 but maintained to be smaller than the first and the second lifter plates 51, 52. Therefore, the angle variation of the topmost recording sheet 3 with respect to the feed roller 61 is maintained to be smaller regardless of the height of the sheet stack so that the topmost recording sheet 3 can be forwarded toward the contact point of the separator roller 62 and the separator pad 62. Further, according to the configuration, the topmost sheet 3 is in the inclined orientation with the front end higher than the rear end; therefore, the recording sheet 3 can be easily guided to the image forming unit 15 without being curved in an acute angle.

According to the first embodiment, movements of the holder plate 50 toward the rear can be partially restricted by the first lifter plate 51, and movements toward the front and in the right-left direction can be restricted by the side walls of the sheet cassette 11. Moreover, it is preferable that a guide mechanism having a guide pin, which is extensible in the up-and-down direction, and a guide groove to guide the pin, is provided so that the movements in the up-and-down direction are allowed whilst the movements in the right-and-left direction are restricted.

Figures 7A, 7B, 7C:
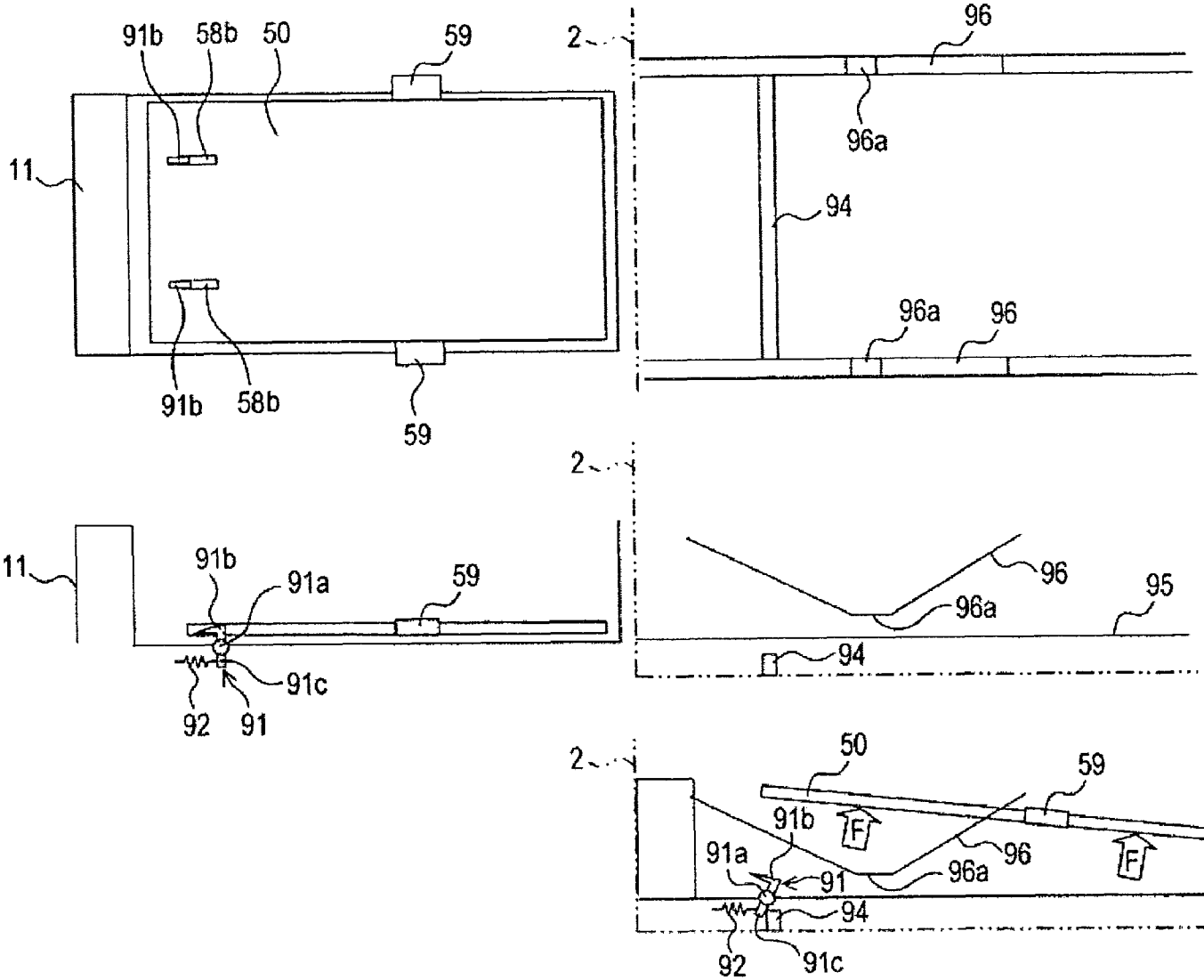
FIGS. 7A-7C illustrate a locking system of the holder plate according to the first embodiment of the present invention.

In the first embodiment, the holder plate 50 can be maintained in the lowest position on the bottom of the sheet cassette 11 against the expanding force of the torsion coil springs 55, 56. The locking system to lock the holder plate 50 on the bottom of the sheet cassette 11 will be described. FIGS. 7A and 7B are a plane view and a side view of the sheet cassette 11 taken out of the casing 2 of the laser printer 1 according to the first embodiment of the present invention. FIG. 7C is a side view of the sheet cassette 11 installed in the casing 2 of the laser printer 1 according to the first embodiment of the present invention. The holder plate 50 is formed to have a pair of rectangular-formed holes 58, which extend in the front-rear direction, in the vicinity of the front end thereof (see FIGS. 3 and 5). Each of the holes 58 includes an opening 58*b*, and edges of each hole 58 are formed to droop downward from the holder plate 50, and a front end portion of the droop is formed to have a bottom portion 58*a*.

Meanwhile, the sheet cassette 11 is provided with claws 91 (see FIG. 7B) on positions corresponding to the openings 58*b*. The claws 91 are rotatable about a shaft 91*a*, which extends in the right-left direction in the sheet cassette 11, and include engageable portions 91*b*, which are engageable with upper surfaces of the bottom portions 58*a* of the holes 58. The claws 91 are pressed rearward by compression coil springs 92 at lower portions 91*c* thereof, accordingly, the engageable portions 92*b* are pressed frontward. Therefore, when the holder plate 50 is pressed downward toward the bottom of the sheet cassette 11, the engageable portions 91*b* of the claws 91 are engaged with the upper surfaces of the bottom portions 58*a* of the holes 58. Thus, the holder plate 50 can be maintained in the vicinity of the bottom of the sheet cassette 11 against the expanding force of the torsion coil springs 55, 56.

Further, the casing 2 of the laser printer 1 is provided with an unlocking beam 94 to extend in the right-left direction. When the sheet cassette 11 is inserted in the casing 2 along tray guides 95, the lower portions 91*c* of the claws 91 are pressed frontward by the unlocking beam 94 against the compression coil spring 92 so that the claws 91 are rotated and the bottom portions 58*a* of the holes 58 are released from the engageable portions 91*b*. Accordingly, the holder plate 50 is uplifted by the expanding force Fs (see FIG. 7C) of the torsion coil springs 55, 56 with the front end thereof uplifted to be higher than the rear end.

Furthermore, according to the present embodiment, the holder plate 50 is provided to have a pair of projections 59 (see FIGS. 7A-7C) at the right and the left sides of the holder plate 50 and at positions closer to the rear end. The projections 59 are arranged to extend beyond the right and left side walls of the sheet cassette 11. Meanwhile, the casing 2 is provided with a pair of guiding cams 96 on inner surfaces of the right and left side walls and in positions closer to the front. Each of the guiding cams 96 is formed to decline toward a lower portion 96*a*, which is provided in the vicinity of a lengthwise center. When the sheet cassette 11 is entirely installed in the casing 2, the projections 59 are in positions closer to the rear with respect to the guiding cams 96; therefore, the holder plate 50 is released from the claws 91 and allowed to be uplifted. When the sheet cassette 11 is removed from the casing 2, the projections 59 are pressed downward by the guiding cams 96 so that the engageable portions 91*b* of the claws 91 are engaged with the bottom surfaces 58*a* of the holes 58 at least when the guide pieces 59 pass underneath the lower portions 96*a*. Thus, when the sheet cassette 11 is removed from the casing 2, the holder plate 50 is locked in the vicinity of the bottom of the sheet cassette 11 so that a new sheet stack of recording sheets 3 can be easily loaded in the sheet cassette 11.

According to the above embodiment, the front end of the holder plate 50 being closer to the feed roller 61 is upraised in a constant speed rate higher than a speed of the rear end to be upraised. Therefore, the holder plate 50 can be moved with the front end to be uplifted higher than the rear end whilst the angle variation of the topmost sheet 3 in the sheet stack placed on the holder plate 50 with respect to the feed roller 61 is moderated so that irregular sheet feeding such as double-feeding and idle-feeding can be prevented from occurring regardless of the amount of the remaining recording sheets in the sheet stack. Further, due to the speed difference of the front end and the rear end to be upraised, the holder plate 50 is inclined with the front end upraised higher, and the sheet 3 can be transported to the image forming unit without being turned at a large angle (e.g., nearly 180 degrees) so that the entire image forming apparatus can be downsized. Furthermore, when the holder plate 50 is in the lowest position in the vicinity to the bottom of the sheet cassette 11, the holder plate 50 can be maintained in substantially parallel with the bottom of the sheet cassette 11 so that the sheet cassette 11 can be easily removed from and installed in the casing 2 when, for example, a new sheet stack is loaded.

Figure 8:
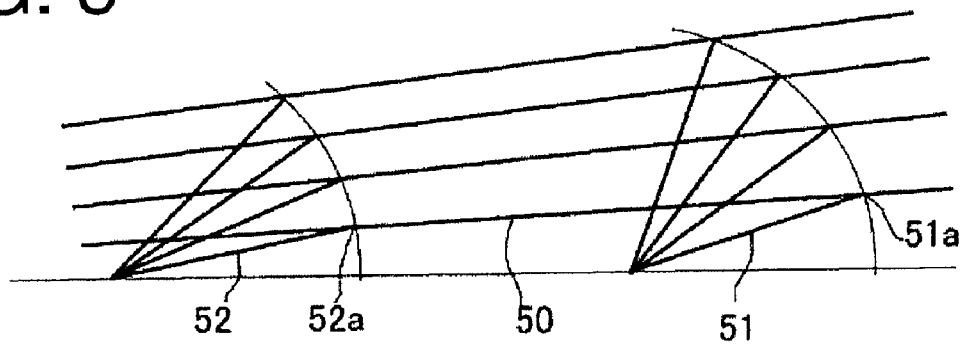
FIG. 8 is an illustrative side view of the holder plate being uplifted according to a second embodiment of the present invention.

Next, a second embodiment of the present invention will be described with reference to FIG. 8. FIG. 8 is an illustrative side view of the holder plate 50 being uplifted according to the second embodiment of the present invention. In the second embodiment, the first lifter plate 51 and the second lifter plate 52 are aligned in line in parallel with the sheet feeding direction, and each of the first lifter plate 51 and the second lifter plate 52 is pivotally attached to the bottom of the sheet cassette 11 to pivot about the rear end thereof. Thus, the front end 51*a* of the first lifter plate 51 and a front end 52*a*' of the second lifter plate 52 are upraised as the first and the second lifter plates 51, 52 are pivoted about the rear ends thereof. Therefore, the first lifter plate 51 and the second lifter plate 52 are upraised to have the respective front ends 51*a*, 52*a*' to be higher than the rear ends thereof, and the first lifter plate 51 and the second lifter plate 52 are oriented in relatively similar inclination. In the second embodiment, similarly to the first embodiment, the first lifter plate 51 is pivoted the according to a speed rate in the constant ratio with respect to a speed rate of the second lifter plate 52 to be pivoted. However, the idle gear 83 is omitted from the gear configuration of the coordinating system 90 to pivot the first lifter plate and the second lifter plate 52 in cooperation with each other in order to have the first lifter plate 51 and the second lifter plate pivoted in the same direction. Alternatively, the gear configuration of the coordinating system 90 may be adjusted to include even numbers of gears in order to have the first lifter plate 51 and the second lifter plate pivoted in the same direction.

Figure 9:
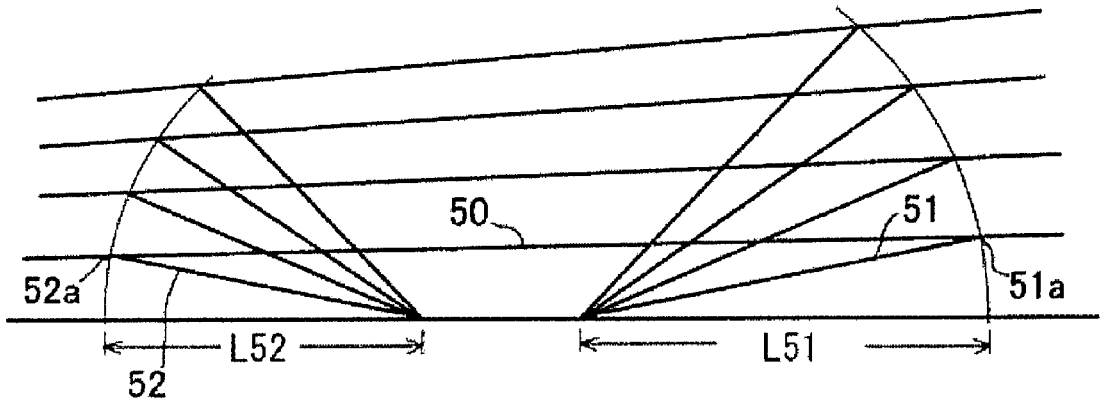
FIG. 9 is an illustrative side view of the holder plate being uplifted according to a third embodiment of the present invention.
Figure 10A:
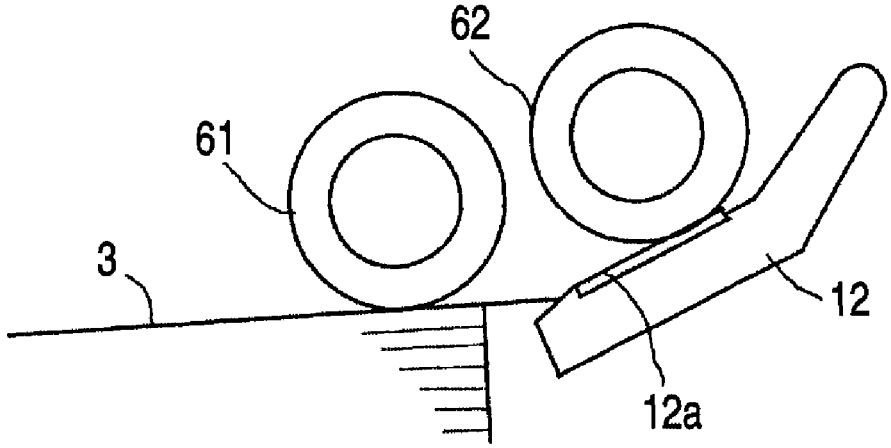
FIGS. 10A and 10B are illustrative side views of the sheet feeding mechanism according to the prior arts.
Figure 10B:
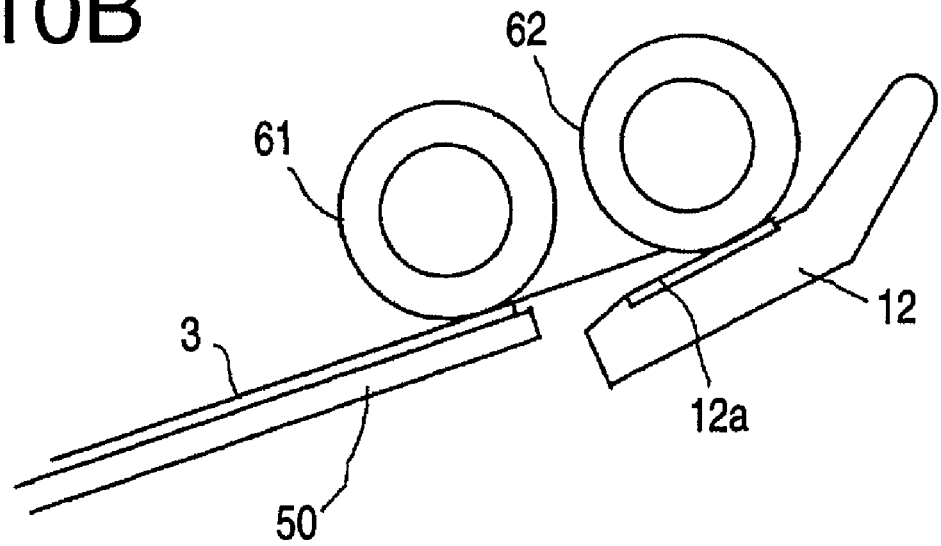

Next, a third embodiment of the present invention will be described with reference to FIG. 9. FIG. 9 is an illustrative side view of the holder plate 50 being uplifted according to the second embodiment of the present invention. In the third embodiment, similarly to the first embodiment, the first and the second lifter plates 51, 52 are arranged in line in parallel with the sheet feeding direction with sides close to each other (i.e., the rear end of the first lifter plate 51 and the front end of the second lifter plate 52) pivotally attached to the bottom of the sheet cassette 11. Thus, the front end 51*a* of the first lifter plate 51 and the rear end 52*a* of the second lifter plate 52 are upraised as the first and the second lifter plates 51, 52 are pivoted about the rear end and the front end respectively. In the third embodiment, however, unlike the first embodiment, a length L51 of the first lifter plate 51 in the front-rear direction is greater than a length L52 of the second lifter plate 52. Further, a pivoting speed of the first lifter plate 51 is equalized with a pivoting speed of the first lifter plate 52. In other words, the amount of the first lifter plate 51 to be pivoted is equal to the amount of the second lifter plate 52. In order to equalize the pivoting speeds of the first and the second lifter plate 51, 52, in the third embodiment, the reduction gear 84 with two different diameters employed in the first embodiment is replaced with a gear with a single diameter so that the first and the second lifter plates 51, 52 are pivoted for a same amount in the equal speed. According to the above configuration, the front end 51*a* of the first lifter plate 51 is upraised higher than the rear end 52*a* of the second lifter plate 52 in a faster speed according to a constant rate with respect to a speed of the rear end of the second lifter plate 52 to be upraised.

Although examples of carrying out the invention have been described, those skilled in the art will appreciate that there are numerous variations and permutations of the sheet feeding device and an image reading apparatus that fall within the spirit and scope of the invention as set forth in the appended claims. It is to be understood that the subject matter defined in the appended claims is not necessarily limited to the specific features or act described above. Rather, the specific features and acts described above are disclosed as example forms of implementing the claims.

For example, the first and the second lifter plates 51, 52 in the first and the second embodiments may have different lengths, similarly to the first and the second lifter plates in the third embodiment. For another example, the first lifter plate 51 and the second lifter plate 52 can be pivoted by other materials than the torsion coil springs, such as rubber and fluid with resiliency. Further, inclination of the holder plate 50 may be adjusted by a single compression coil spring provided at a portion in the vicinity of gravity center of the holder plate 50. However, it is to be noted in the above-described embodiments, that the first lifter plate 51 and the second lifter plate 52 are respectively provided with the torsion coil springs 55, 56 so that the first lifter plate 51 and the second lifter plate 52 can be equally biased and the inclination of the holder plate 50 can be steadily controlled.

For another example, a source of drive-force to drive one of the idle gear 83 and the reduction gear directly, e.g., a motor, can replace the torsion coil springs 55, 56. It is to be noted that, in this configuration with the motor, the movements of the holder plate 50 can be controlled even more finely.

Furthermore, the amounts of the first lifter plate 51 and the second lifter plate 52 to be pivoted in cooperation with each other can be adjusted by, for example, a belt or a link. However, adjusting the amounts to be pivoted by the gears, as described in the above embodiment, can be more easily configured with a simple structure so that the entire apparatus can be downsized. When the gears are employed to adjust the pivoted amounts of the lifter plates, the first gear 81 and the second gear 82 may be replaced with disk-shaped wheel gears, which can be directly or indirectly engaged with each other.

What is claimed is:

1. A sheet feeding device to feed a sheet in a sheet stack into a sheet feeding path along a sheet feeding direction, comprising:

a sheet holder to hold the sheet in a position to be fed;

a feed roller to be rotated to pick up the sheet from the sheet stack and arranged in a position, in which the sheet comes in contact with the feed roller;

a first lifter, having a front end and a rear end, to move a first portion of the sheet holder, which is closer to the feed roller, by one of the front end and the rear end, the first lifter being pivotable about the other one of the front end and the rear end;

a second lifter, having a front end and a rear end, to move a second portion of the sheet holder, which is further from the feed roller than the first portion, by one of the front end and the rear end, the second lifter being pivotable about the other one of the front end and the rear end; and a coordinating system to move the first lifter and the second lifter in cooperation with each other at different rates of speed to move the overall sheet holder in a direction to be closer to the feed roller;

wherein the first lifter moves the sheet holder at a rate of speed, which is greater than a rate of speed that the second lifter moves the sheet holder so that an amount of the sheet holder to be moved by the first lifter is greater than an amount of the sheet holder to be moved by the second lifter, and wherein the coordinating system moves the first lifter to pivot about the other one of the front end and the rear end at a rate of speed that is greater than a rate of speed that the coordinating system moves the second lifter to pivot about the other one of the front end and the rear end.

2. The sheet feeding device according to claim 1, wherein the sheet holder is held by the first lifter and the second lifter at portions, which are in line in parallel with the sheet feeding direction having a gravity center of the sheet holder therebetween.

3. The sheet feeding device according to claim 1, wherein the first lifter is pivotable about the rear end thereof and moves the sheet holder by the front end thereof;

wherein the second lifter is pivotable about the front end thereof and moves the sheet holder by the rear end thereof.

4. The sheet feeding device according to claim 1, wherein the first lifter and the second lifter are moved by the coordinating system to have the front ends thereof be higher than the rear ends thereof respectively.

5. The sheet feeding device according to claim 1, wherein the first lifter is pivotable about the other one of the front end and the rear end;

wherein the second lifter is pivotable about the other one of the front end and the rear end; and wherein a length between the front end and the rear end of the first lifter is greater than a length between the front end and the rear end of the second lifter.

6. The sheet feeding device according to claim 5, wherein the first lifter is pivotable about the rear end thereof and moves the sheet holder by the front end thereof;

wherein the second lifter is pivotable about the front end thereof and moves the sheet holder by the rear end thereof.

7. The sheet feeding device according to claim 5,
wherein the first lifter and the second lifter are moved by the coordinating system to have the front ends thereof be higher than the rear ends thereof respectively.

8. The sheet feeding device according to claim 1,
wherein each of the first lifter and the second lifter is formed to have a width which extends perpendicularly to the sheet feeding direction; and
wherein the first lifter upholds the sheet holder at least by two portions in the one of the front end and the rear end thereof; and
wherein the second lifter upholds the sheet holder at least by two portions in the one of the front end and the rear end thereof.

9. The sheet feeding device according to claim 1,
wherein the coordinating system includes a first gear, which is coupled to the first lifter, and a second gear, which is coupled to the second lifter; and
wherein the first gear and the second gear cooperate with each other according to a predetermined gear ratio.

10. The sheet feeding device according to claim 9,
wherein each of the first lifter and the second lifter is formed to have a width which extends perpendicularly to the sheet feeding direction; and
wherein each of the first gear and the second gear is arranged on a widthwise edge of the first gear and the second gear respectively in a position to be outside of a widthwise edge of the sheet holder.

11. The sheet feeding device according to claim 9,
wherein the first lifter is pivotable about a pivot axis corresponding to the other one of the front end and the rear end;
wherein the second lifter is pivotable about a pivot axis corresponding to the other one of the front end and the rear end;
wherein the first gear and the second gear are sector-formed gears which are rotatable about axes corresponding to the pivot axes of the first lifter and the second lifter respectively.

12. The sheet feeding device according to claim 9,
wherein the first gear and the second gear are interlocked with each other indirectly through at least one intermediate gear.

13. The sheet feeding device according to claim 12,
wherein the at least one intermediate gear is a reduction gear having a larger diameter portion to be engaged with the first gear and a smaller diameter portion to be engaged with the second gear.

14. The sheet feeding device according to claim 1,
further comprising a drive-force source to drive the first lifter and the second lifter so that the overall sheet holder is moved in the direction to be closer to the feed roller.

15. The sheet feeding device according to claim 14,
wherein the drive-force source includes at least one resilient member, which drives the first lifter and the second lifter respectively in directions to have the overall sheet holder be closer to the feed roller.

16. The sheet feeding device according to claim 1,
further comprising a cassette, which is removably installed in the sheet feeding device and is configured to be withdrawn from the sheet feeding device in a withdrawal direction parallel with the sheet feeding direction; and
wherein the sheet holder, the first lifter, and the second lifter are configured to be substantially parallel with the direction that the cassette is configured to be withdrawn.

17. The sheet feeding device according to claim 16, further comprising:
at least one resilient member, which drives the first lifter and the second lifter respectively in directions to have the overall sheet holder be closer to the feed roller;
wherein the cassette includes at least one claw portion, which locks the sheet holder in the orientation substantially parallel with the withdrawal direction against resiliency of the resilient member driving the first lifter and the second lifter; and
wherein the sheet feeding device further comprises at least one unlocking member, which is operated by an installing motion of the cassette in the sheet feeding device, to release the sheet holder from the at least one claw portion.

18. The sheet feeding device according to claim 1, further comprising
a separator arranged in a downstream side of the sheet feeding path with respect to the feed roller to separate the sheet from a succeeding sheet in the sheet stack.

19. An image forming apparatus, comprising:
a sheet feeding device to feed a sheet in a sheet stack along a sheet feeding direction;
an image forming unit, arranged on a portion substantially above the sheet feeding device, to form an image on the sheet being fed by the sheet feeding device; and
a sheet feeding path to guide the sheet being fed by the sheet feeding device upwardly to the image forming unit,
wherein the sheet feeding device includes:
a sheet holder to hold the sheet in a position to be fed;
a feed roller to be rotated to pick up the sheet from the sheet stack and arranged in a position, in which the sheet comes in contact with the feed roller;
a separator arranged in a downstream side of the sheet feeding path with respect to the feed roller to separate the sheet from a succeeding sheet in the sheet stack;
a first lifter, having a front end and a rear end, to move a first portion of the sheet holder, which is closer to the feed roller, by one of the front end and the rear end, the first lifter being pivotable about the other one of the front end and the rear end;
a second lifter, having a front end and a rear end, to move a second portion of the sheet holder, which is further from the feed roller than the first portion, by one of the front end and the rear end, the second lifter being pivotable about the other one of the front end and the rear end; and
a coordinating system to move the first lifter and the second lifter in cooperation with each other at different rates of speed to move the overall sheet holder in a direction to be closer to the feed roller;
wherein the first lifter moves the sheet holder at a rate of speed, which is greater than a rate of speed that the second lifter moves the sheet holder so that an amount of the sheet holder to be moved by the first lifter is greater than an amount of the sheet holder to be moved by the second lifter, and
wherein the coordinating system moves the first lifter to pivot about the other one of the front end and the rear end at a rate of speed that is greater than a rate of speed that the coordinating system moves the second lifter to pivot about the other one of the front end and the rear end.

* * * * *